US005680803A

United States Patent [19]

Vizurraga et al.

[11] Patent Number: 5,680,803

[45] Date of Patent: Oct. 28, 1997

[54] COLLAPSIBLE SLICING GUIDE

[75] Inventors: Luie R. Vizurraga, Painsville, Ohio; Robert Lascak, East Springfield, Pa.

[73] Assignee: Allied Resinous Products, Inc., Conneaut, Ohio

[21] Appl. No.: 584,018

[22] Filed: Jan. 11, 1996

[51] Int. Cl.[6] ..... B26D 7/01

[52] U.S. Cl. ..... 83/762; 83/468.5; 83/932

[58] Field of Search ..... 83/761, 762, 932, 83/454, 766, 466.1, 467.1, 468.4, 468.5

[56] References Cited

U.S. PATENT DOCUMENTS

| | | | |
|---|---|---|---|
| 1,072,450 | 9/1913 | Hamblin | 83/762 |
| 1,307,397 | 6/1919 | Garlock | 83/762 |
| 1,345,376 | 7/1920 | Leonard | 83/762 |
| 2,398,192 | 4/1946 | Scheminger, Jr. | 83/762 |
| 4,807,505 | 2/1989 | Campbell et al. | 83/762 |
| 5,386,755 | 2/1995 | Schneider et al. | 83/762 |
| 5,440,959 | 8/1995 | Bindon et al. | 83/762 |

OTHER PUBLICATIONS

"Bread Slicers", Great Lakes Designs Product Catalog, Apr. 1996.

"Roger Fortney's Perfect Slices", Homeworld Business Small Electrics, Jan. 9–22, 1995, p. 183.

"Acrylic Bread Slicer", Homeworld Business New Products, Jan. 23–Feb. 5, 1995, p. 38.

"Farberware, Coffee, Bagel & Bread Accessories", Kitchenware News, May 1996, p. 22.

*Primary Examiner*—Kenneth E. Peterson

*Attorney, Agent, or Firm*—Banner & Witcoff, Ltd.

[57] ABSTRACT

A collapsible slicing guide enabling safe and even slicing comprising a cutting surface base, a pair of collapsible uprights pivotally connected to the base by a collapsible hinge construction in parallel, opposed relation. The uprights are pivotally movable from an operative position which they are in upstanding and face one another, to a storage position in which they are collapsed flat against the base: one upright folded on top of the base and the other upright folded underneath the base. The slicing guide also comprises a plurality of parallel, spaced slits extending vertically in each of the uprights. The slits extend substantially to the base and define therebetween a plurality of columns. The slits are arranged so that a slit of one upright is aligned with a corresponding slit of the other upright so that each such pair of slits is adapted to receive and guide a knife blade.

7 Claims, 8 Drawing Sheets

COLLAPSIBLE SLICING GUIDE

FIELD OF THE INVENTION

The present invention relates to a collapsible slicing guide, and more particularly to a slicing guide for safely and evenly slicing foods such as bread, meat and vegetables.

BACKGROUND OF THE INVENTION

The collapsible food slicing guide of the present invention was developed to fill several needs, in summary: how to safely and evenly slide foods such as bread loaves, meat and vegetables while ensuring a sanitary cutting surface and allowing for compact storage.

With the recent popularity of bread making machines there has been a significant increase in people baking bread at home. Generally the bread loaves that are baked in the machines are larger than traditional pan-baked loaves in the height and width dimensions. There have been a few attempts to solve the problem of safely and evenly slicing a loaf of homemade bread.

One prior slicing guide having upright guides is made of wood and requires a wide base or cutting surface in order to permit both sidewalls to fold down on the top surface of the base. In such models, the sidewalls are generally too short to sufficiently contain a bread loaf having a large height dimension such as those produced by home bread making machines. Due to the extreme width of the base, when a standard loaf is sliced the bread gets dragged from sidewall to sidewall by the motion of the knife which prevents uniform cutting.

In addition, the tops of the sidewall columns of the prior slicing guide are squared off, they present a flat surface for the knife to contact resulting in possible splintering of the wood. This can present a hazard if the wood splinters are found in the bread slices.

There has been a need for a totally collapsible slicing guide that is configured to stably contain bread loaves and other foods and which has features to enable safe and smooth guiding of a knife.

SUMMARY OF THE INVENTION

Accordingly, the present invention provides a plastic slicing guide which collapses totally for compact storage.

The slicing guide of the present invention comprises a cutting surface base and a pair of collapsible, opposed uprights. One of the uprights folds down flush onto the top surface of the base, and the other upright folds flush underneath the base to provide a nearly flat collapsed article.

More specifically, the collapsible slicing guide enables safe and even slicing and comprises a cutting surface base, a pair of collapsible uprights pivotally connected to the base by a collapsible hinge construction in parallel, opposed relation. The uprights are pivotally movable from an operative position which they are in upstanding and face one another, to a storage position in which they are collapsed flat against the base: one upright folded on top of the base and the other upright folded underneath the base. The slicing guide also comprises a plurality of parallel, spaced slits extending vertically in each of the uprights. The slits extend substantially to the base and define therebetween a plurality of columns. The slits are arranged so that a slit of one upright is aligned with a corresponding slit of the other upright so that each such pair of slits is adapted to receive and guide a knife blade.

The collapsible hinge construction includes indentations formed in the base for accommodating hinge assemblies.

Each of the uprights has attached to it a hinge block so as to form the short leg of an L-shaped hinge assembly. The indentations in the base are sized to receive this short leg of the L-shaped hinge assembly. In the operative position, both L-shaped hinge assemblies are identically arranged, that is, the short legs point in the same direction. The pivotable connection of the hinge assemblies to the base are configured through the upright portion of the hinge assembly to enable one upright to fold flush on top of the base and the other upright to fold flush underneath the base.

The present slicing guide also provides rounded column tops to guide a knife into the slits while preventing cutting into the column tops as with the prior squared off tops.

These and other features and advantages of the invention may be more completely understood from the following detailed description of the preferred embodiment of the invention with reference to the accompanying drawings.

DETAILED DESCRIPTION OF THE PREFERRED EMBODIMENT

Figure 1:
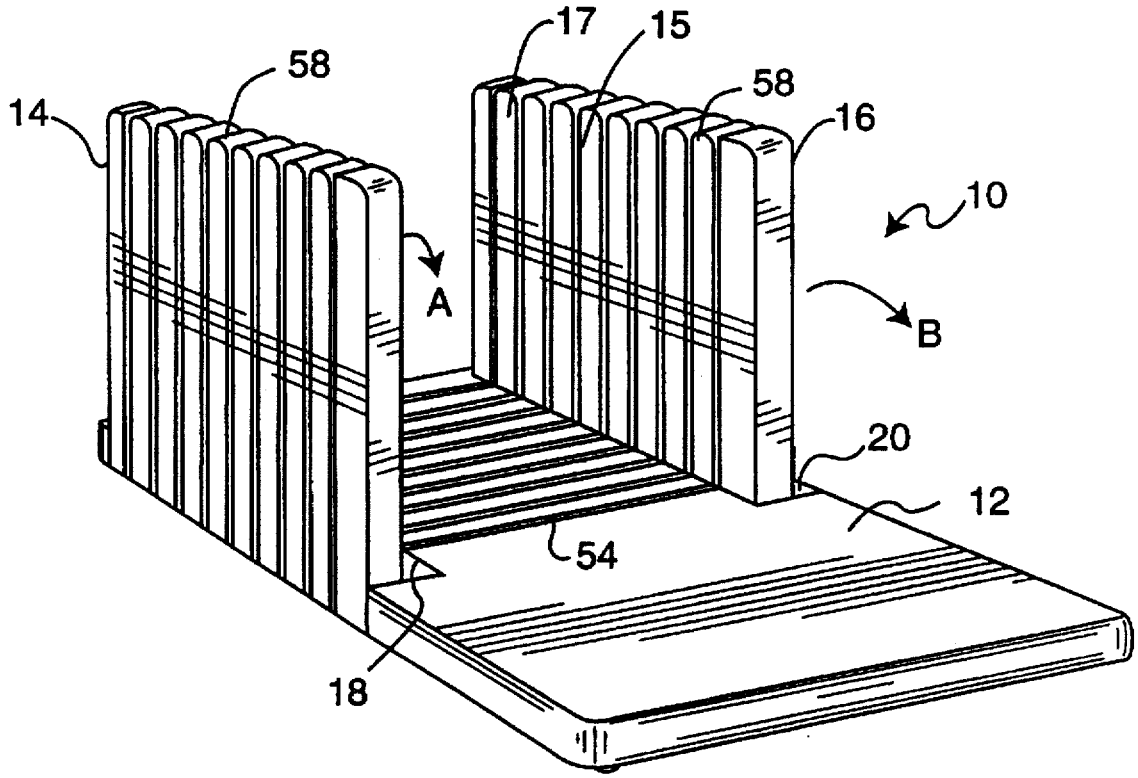
FIG. 1 is a perspective view of the slicing guide of the present invention shown in the operative position.
Figure 2:
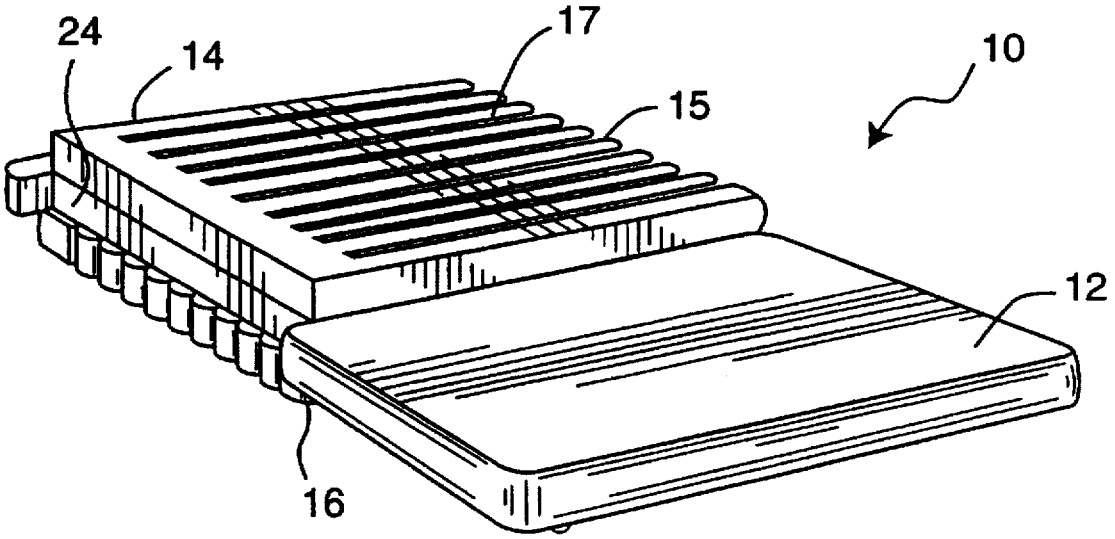
FIG. 2 is a perspective view of the slicing guide of FIG. 1 shown in the collapsed position.
Figure 3:
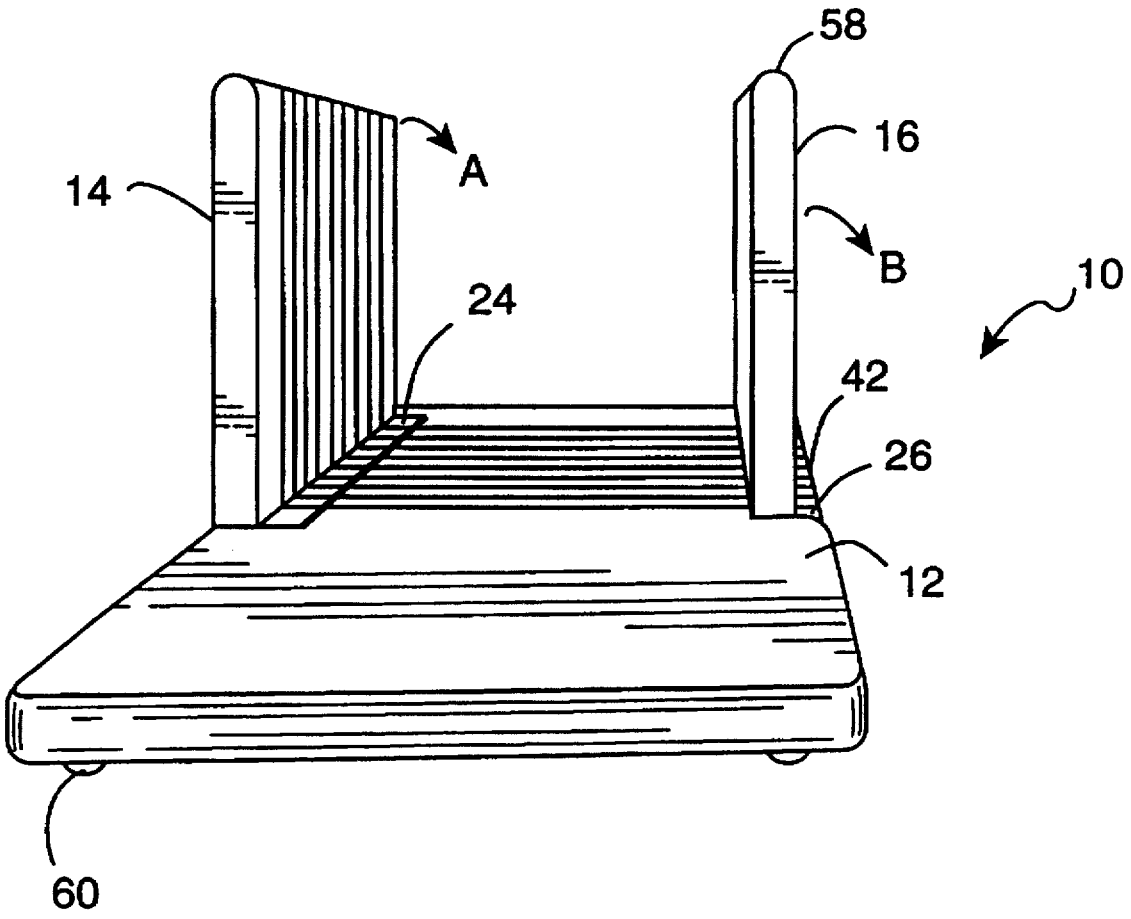
FIG. 3 is another perspective view of the slicing guide shown slightly rotated clockwise from the arrangement of FIG. 1.
Figure 4:
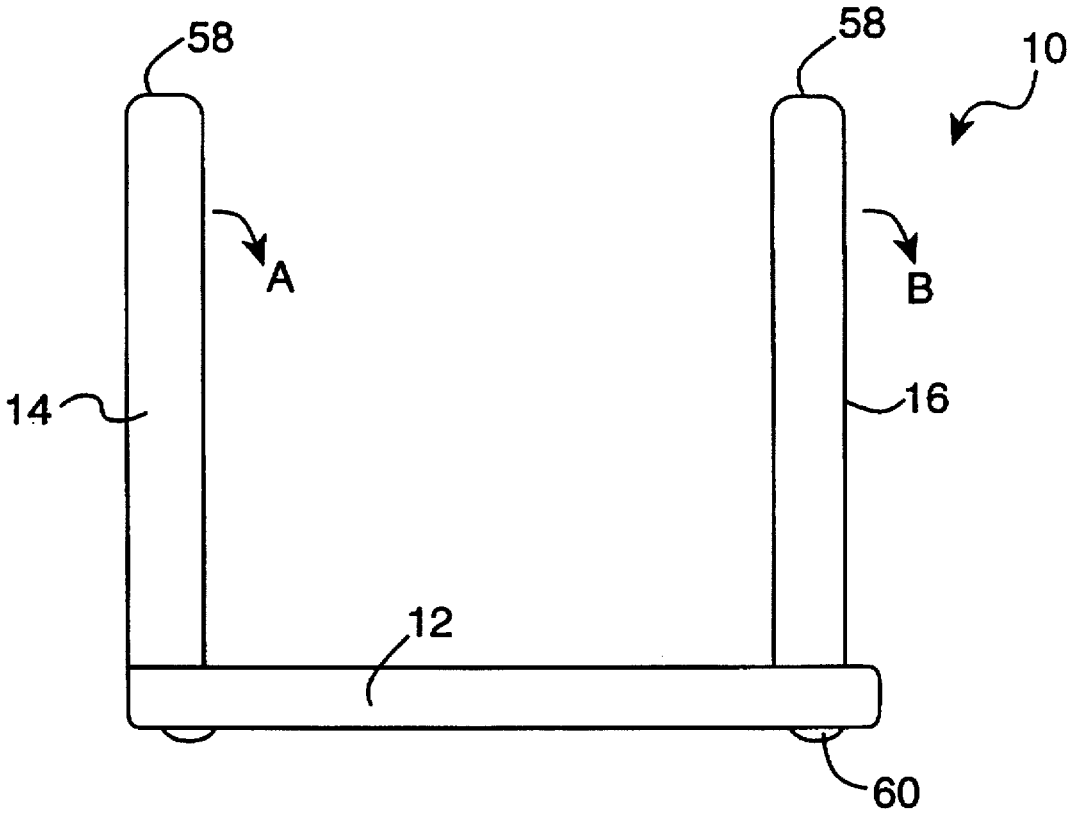
FIG. 4 is a front elevational view of the slicing guide of FIG. 1.
Figure 6:
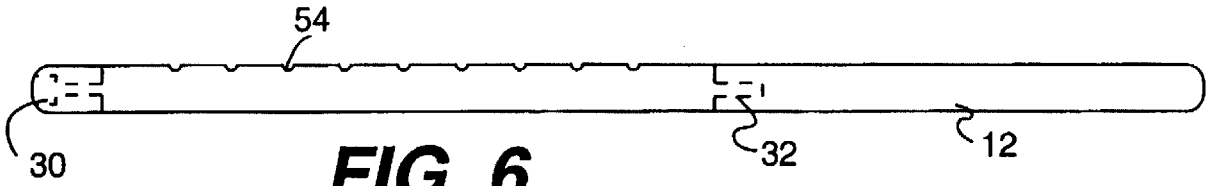
FIG. 6 is a side elevational view of the base of FIG. 5.
Figure 7:
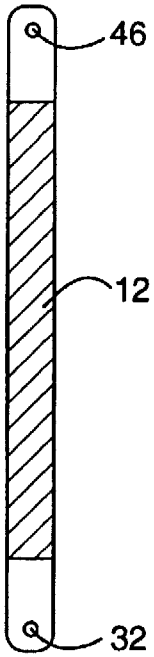
FIG. 7 is a cross-sectional view taken along line 7—7 of FIG. 5.
Figure 5:
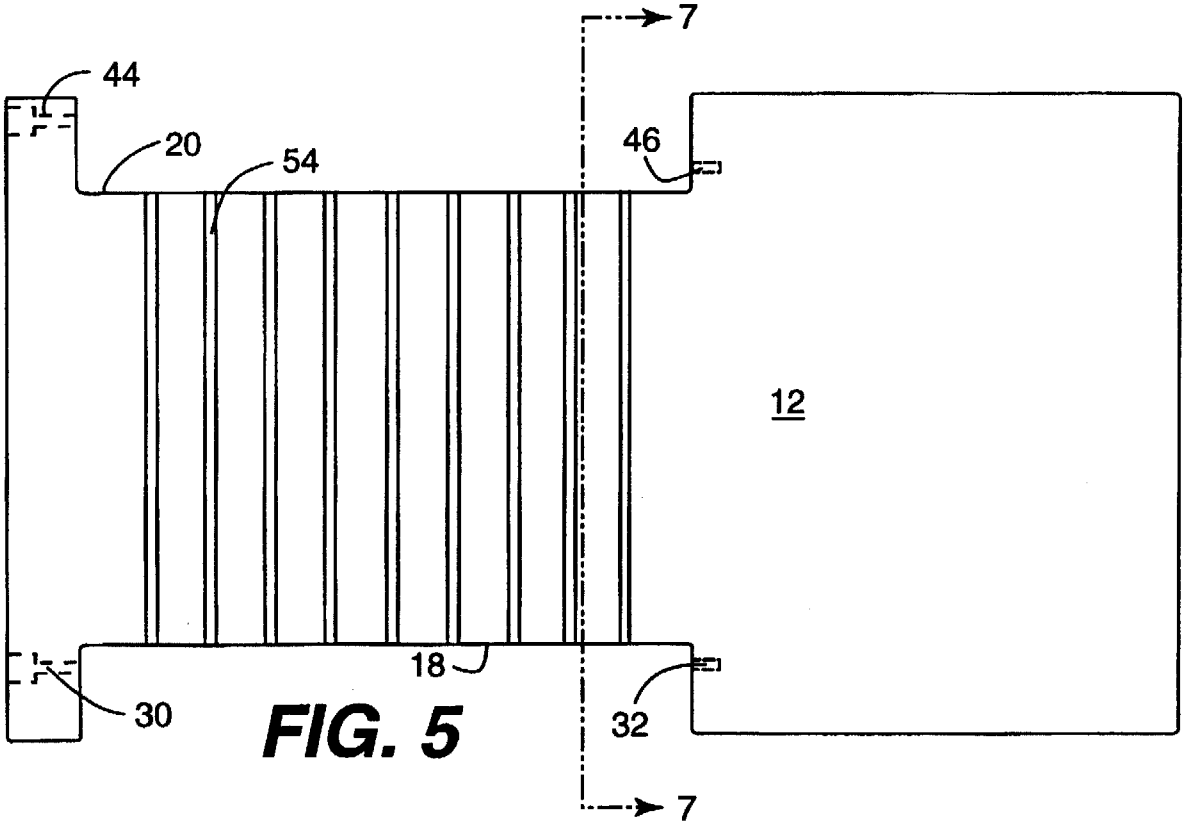
FIG. 5 is a top plan view of the base of the slicing guide of FIG. 1.
Figure 9:
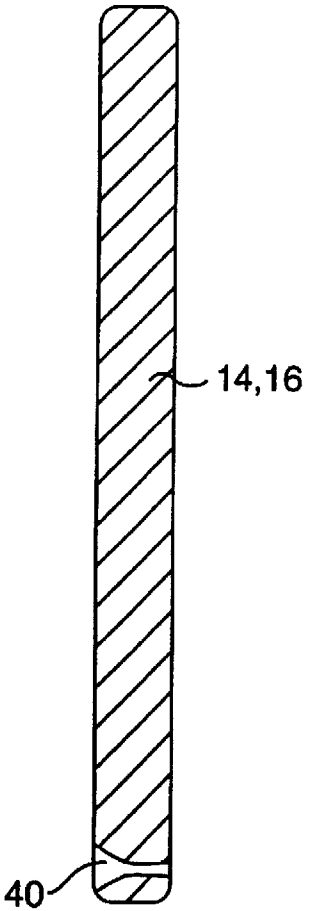
FIG. 9 is a cross-sectional view taken along line 9—9 of FIG. 8.
Figure 8:
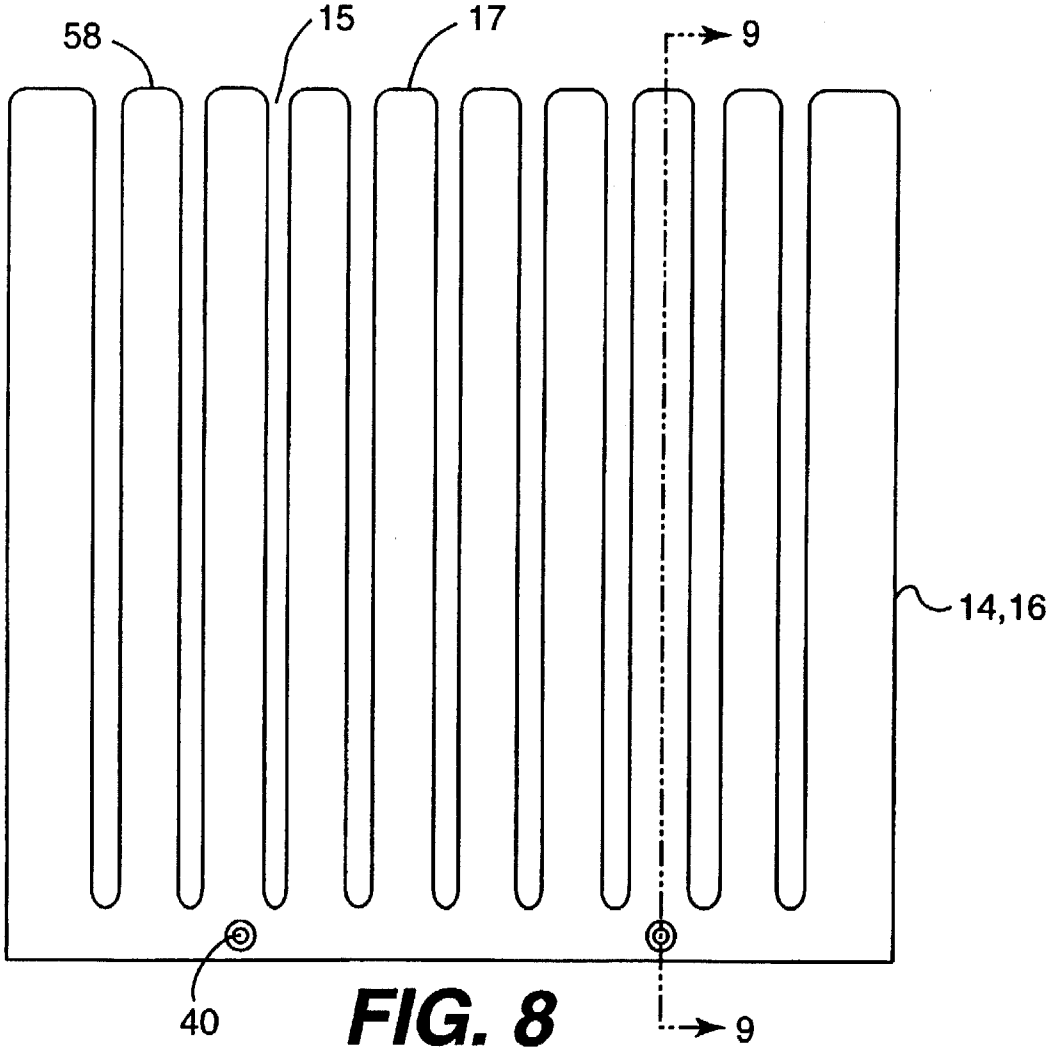
FIG. 8 is a side elevational view of an upright of the slicing guide of FIG. 1.

Referring to FIGS. 1–4 a slicing guide 10 is shown assembled from its three main components: a cutting surface base 12 and a pair of uprights 14 and 16 pivotably connected to base 12. Base 12 includes an open area to one end with generally rounded corner edges 13 and a slicing area on the other end. FIGS. 1, 3 and 4 illustrate slicing guide 10 in the operative position, that is, with uprights 14 and 16 facing one another in the slicing area. FIG. 2 illustrates slicing guide 10 in the collapsed position for storage in which upright 14 is folded onto the top surface of base 12 in the direction of arrow A and upright 16 is folded in the direction of arrow B underneath base 12. As illustrated, both uprights 14 and 16 are folded in the clockwise direction.

Uprights 14 and 16 each includes a plurality of parallel slits 15 which are aligned with one another so that a pair of slits can receive and guide a knife therein. Slits 15 define therebetween columns 17, the width of which determines the thickness of the slice. Slits 15 extend substantially to base 12 when uprights 14 and 16 are assembled on base 12 and in the operative position so that a knife received in a pair of slits can cut to the bottom of an article placed between the uprights. Slits 15 may be spaced at any desired interval, but in the preferred embodiment which is particularly suited for slicing bread loaves, columns 17 are 0.5 inches wide for 0.5 inch wide bread slices. Of course the thickness of the slices can be varied by moving the article longitudinally in the slicing area for thicker or thinner slices.

Referring to FIGS. 5–7 and 10–15, the hinge construction that pivotably connects uprights 14 rand 16 to base 12 so as to allow the complete collapsibility as shown in FIG. 2 is housed in a pair of indentations 18 and 20 formed in base 12. Hinge assemblies consisting of an upright and a hinge block attached to one another to form an L-shape are arranged so that the short leg of the L-shape is received in an indentation. For ease of explanation right-hand and left-hand directions are used to describe the slicing guide with respect to FIG. 1, however, they should be more broadly thought of as a first and a second direction. For example, the left hinge assembly consists of upright 14 with hinge block 24 attached thereto, and the right hinge assembly consists of upright 16 with hinge block 26 attached thereto. Both hinge assemblies are oriented in the same direction, that is, the short legs of both L-shapes point in the same direction when these hinge assemblies are attached to base 12. The result is that in the left-hand hinge assembly, the left side of upright 14 is flush with the left edge of the open area of base 12, and hinge block 24 extends inwardly. In the right-hand hinge assembly, the left side of upright 16 is flush against indentation 20 of base 12, and hinge block 26 extends outwardly.

Figure 10:
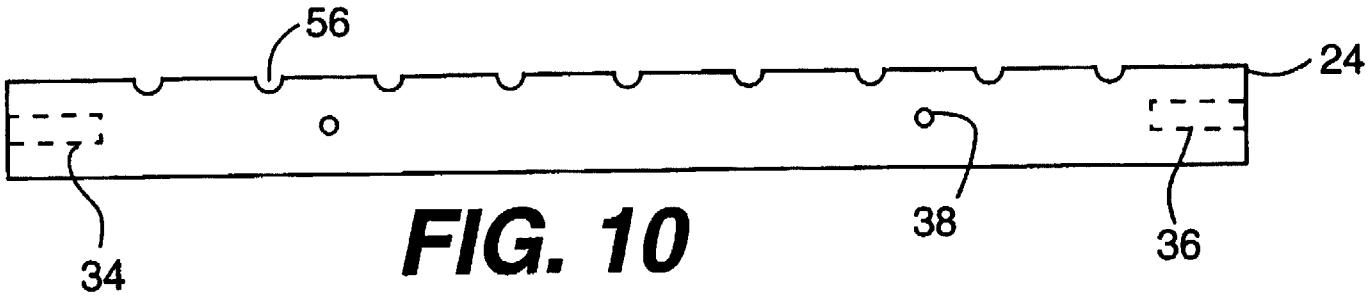
FIG. 10 is a side elevational view of the inwardly extending hinge block of the slicing guide of FIG. 1, shown in FIG. 1 on the left-hand side.
Figure 11:
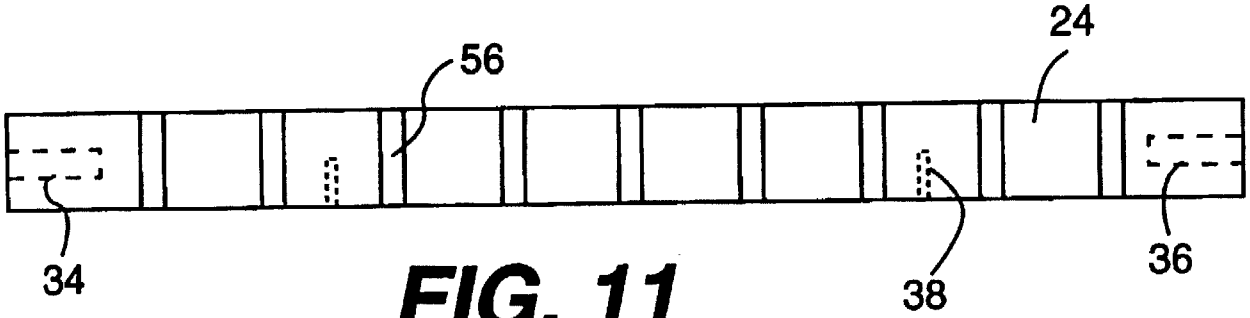
FIG. 11 is a top plan view of the hinge block of FIG. 10.
Figure 12:
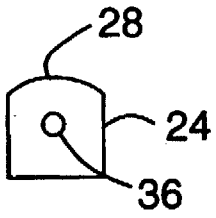
FIG. 12 is an end elevational view of the hinge block of FIG. 10.

As best seen in FIGS. 10–12, hinge block 24 has a rounded top side 28 so that in the operative position, rounded side 28 is aligned with the curve of the base. The endmost surfaces of uprights 14, 16 that bear against indentations 18 and 20 are preferably rounded so that the rounded ends bear frictionally against the straight vertical sides of indentations 18 and 20. This contact between the rounded ends and the vertical sides of indentations 18 and 20 results in some fictional resistance so that when uprights 14 and 16 are in the operative position, they are held there by this frictional engagement, and ensures that a positive force must be applied in the direction of arrow A to fold upright 14 down onto the top surface of base 12 and in the direction of arrow B to fold upright 16. In addition, if an article to be sliced were oddly shaped or slightly smaller than the space in the slicing area, then upright 14 could be tilted in the direction of arrow A to overlay a portion of the article while being sliced. The ends of indentation 18 adjacent the interior end of the indentation includes apertures 30 and 32 which are arranged to align with apertures 34 and 36 respectively of hinge block 24. Hinge block 24 is pivotably connected to base 12 by stainless steel pins and screws received in aligned apertures 30 and 34, and aligned apertures 32 and 36. Upright 14 is attached to hinge block 24 by stainless steel screws received in apertures 38 of block 24 aligned with apertures 40 in upright 14. Apertures 30 and 40 include recessed areas to receive the head of the screws.

Figure 13:
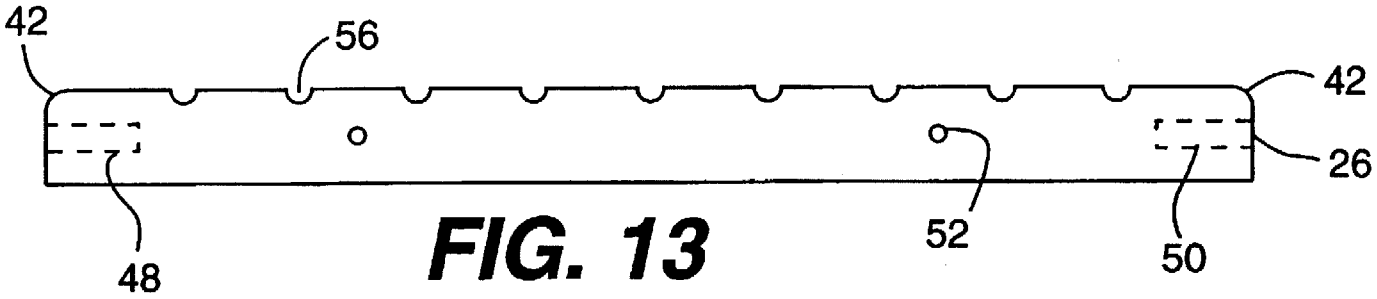
FIG. 13 is a side elevational view of the outwardly extending hinge block of the slicing guide of FIG. 1, shown in FIG. 1 on the right-hand side.
Figure 14:
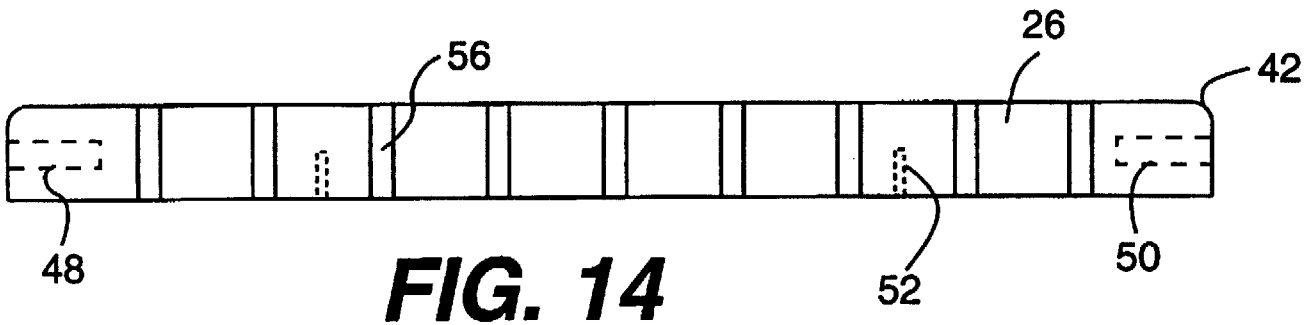
FIG. 14 is a top plan view of the hinge block of FIG. 13.
Figure 15:
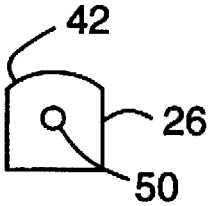
FIG. 15 is an end elevational view of the hinge block of FIG. 13.

As best seen in FIGS. 13–15, hinge block 26 has a rounded corner edge 42 so that in the operative position, rounded corner edge 42 is generally contiguous with rounded corner edge 13 of base 12. The ends of indentation 20 adjacent the side edge of base 12 include apertures 44 and 46 which are arranged to align with apertures 48 and 50 respectively of hinge block 26. Hinge block 26 is pivotably secured to base 12 by stainless steel pins and screws received in aligned apertures 44 and 48, and aligned apertures 46 and 50. Upright 16 is attached to hinge block 26 by stainless steel screws received in apertures 52 of block 26 and apertures 40 in upright 16. Apertures 44 and 40 preferably include recessed areas to receive the heads of the screws.

As can be seen from the drawings showing the assembled slicing guide 10, and particularly in FIGS. 3 and 4, both L-shaped hinge assemblies are oriented in the same direction so that on the left side hinge block 24 extends inwardly, and on the right side hinge block 26 extends outwardly when in the operative position. The pivotable hinge connections of both hinge assemblies are achieved through their respective hinge blocks 24 and 26 so that the pivot axis of upright 14 is closer to the interior of base 12, and the pivot axis of upright 16 is closer to the outer edge of base 12. These connection points and the hinge blocks allow for the clockwise movement of both uprights so that in the completely collapsed position, upright 14 overlies base 12 and upright 16 is flush against the bottom of base 12 to present a very compact device for storage purposes.

Another feature of slicing guide 10 is the provision of grooves 54 extending laterally across the top of base 12 in the slicing area. Grooves 54 are aligned with corresponding pairs of slits 15 to provide a resting place for a knife lower than the top surface of base 12 to ensure that a cut is completed through the article. The top surfaces of hinge blocks 24 and 26 also have corresponding aligned grooves 56.

A feature for more securely guiding a knife in the present invention has to do with the rounded tops 58 of columns 17. The rounded surface tends to lead a knife blade into slit 15 instead of cutting into the tops of columns 17 as with the prior squared off configuration. These rounded tops offer a user a much easier guide. This is especially advantageous when using an electronic carving knife, for example, which generally cuts faster and therefore requires more careful handling and guidance.

To ensure a secure placement of slicing guide 10 on a countertop or like surface, the bottom of base 12 is preferably provided with feet 60. Feet 60 are preferably placed at each of the four corners of the bottom of base 12, and are preferably of a high friction material to grip the countertop while slicing.

While any engineering resin could be used in making the slicing guide, such as polyamides, polyesters, plastic composites and other plastic sheet stock, a preferred material for the slicing guide is a polyolefin, which includes polyethylenes, low and high density polypropylenes and mixtures thereof, because of their cost advantages and mechanical properties. Polyolefins are generally dishwasher safe and resist warping even when wetted and dried frequently. Polyolefins are also one of the most economical plastic raw materials offering sufficient rigidity for stability of the uprights.

The preferred embodiment was machined from polyolefin sheet material, however other methods of manufacture are contemplated to be within the scope of the invention, as well as other materials such as woods and metals. While the preferred embodiment employs stainless steel hardware, other types of hardware such as integrally formed mating depressions and nubs, or pins and screws of other non-corrosive materials are also contemplated to be within the scope of the invention.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

We claim:

1. A collapsible slicing guide for enabling safe and even slicing, said slicing guide comprising:

a cutting surface base;

a pair of collapsible uprights pivotally connected to said base by a corresponding pair of collapsible hinge constructions in parallel, opposed relation, said uprights pivotally movable from an operative position which they are upstanding and face one another to a storage position in which they are collapsed flat against said base said hinge constructions adapted to allow a first upright to collapse on top of said base and a second upright to collapse underneath said base such as to provide a compact collapsed form with substantially flush edges; and a plurality of parallel, spaced slits extending vertically in each said upright substantially to said base, said slits defining therebetween a plurality of columns, said slits arranged such that a slit of said first upright is aligned with a slit of said second upright so that each such pair of slit is adapted to receive and guide a knife blade therein.

2. The slicing guide of claim 1, further comprising a first indentation being formed on a first side of said base and a second indentation being formed on a second side of said base for accommodating said first and second uprights respectively.

3. The slicing guide of claim 2, further comprising a first hinge block attached to said first upright to provide a first L-shaped hinge assembly and a second hinge block attached to said second upright to provide a second L-shaped hinge assembly, said first hinge assembly pivotally connected to said base such that said first hinge block extends outwardly and said second hinge assembly pivotally connected to said base such that said second hinge block extends inwardly.

4. The slicing guide of claim 3, wherein said first hinge assembly is pivotally connected to said base through said outwardly extending first hinge block to enable said first upright to fold underneath said base.

5. The slicing guide of claim 3, wherein said second hinge assembly is pivotally connected to said base through said inwardly extending second hinge block to enable said second upright to fold onto the top surface of said base.

6. The slicing guide of claim 1, further comprising a plurality of grooves in said cutting surface, each said groove being aligned with each said pair of slits.

7. The slicing guide of claim 1, wherein said columns have rounded corners on their top surfaces to guide a knife blade into said slits.

* * * * *